US005711519A

United States Patent [19]

Bortolotti

[11] Patent Number: 5,711,519

[45] Date of Patent: Jan. 27, 1998

[54] DEVICE FOR FEEDING FLAT MATERIAL

[75] Inventor: Giuseppe Bortolotti, Yverdon-Les Bains, Switzerland

[73] Assignee: OCD S.A., Yverdon-Les Bains, Switzerland

[21] Appl. No.: 644,102

[22] Filed: May 10, 1996

[30] Foreign Application Priority Data

Jul. 10, 1995 [CH] Switzerland ..... 2000/95

[51] Int. Cl.[6] ..... B65H 3/06

[52] U.S. Cl. ..... 271/116; 271/119; 271/121; 271/127; 271/145; 271/167

[58] Field of Search ..... 271/104, 116, 271/119, 121, 126, 127, 145, 171, 161, 167

[56] References Cited

U.S. PATENT DOCUMENTS

| | | | |
|---|---|---|---|
| 3,825,249 | 7/1974 | Zimmer | 271/114 |
| 4,003,567 | 1/1977 | Berger et al. | 271/12 |
| 5,253,854 | 10/1993 | Tanoue et al. | 271/121 |
| 5,358,230 | 10/1994 | Ikemori et al. | 271/119 |
| 5,372,359 | 12/1994 | Miura et al. | 271/119 |
| 5,419,543 | 5/1995 | Nakamura et al. | 271/116 |
| 5,527,028 | 6/1996 | Ishikawa | 271/116 |
| 5,613,672 | 3/1997 | Tanaka et al. | 271/171 |

FOREIGN PATENT DOCUMENTS

| | | | |
|---|---|---|---|
| 0231738 | 9/1989 | Japan | 271/171 |
| 403162331 A | 7/1991 | Japan | 271/119 |
| 404094339 A | 3/1992 | Japan | 271/121 |
| 404148737 A | 5/1992 | Japan | 271/119 |

*Primary Examiner*—H. Grant Skaggs
*Attorney, Agent, or Firm*—Young & Thompson

[57] ABSTRACT

The feed device comprises a supply chamber (6) with a forward wall (9) having an inclined plane (45) provided with retaining elements for the stack of sheets contained in the supply chamber in the form of strips of cut pile fabric (48) whose fibers retain the sheets by their forward edge. A drive shaft (23) carries drive rolls (20) comprising a sector (100) with high coefficient of friction to drive the top sheet from the stack and a sector (101) with low coefficient of friction permitting sliding of the sheet during an alignment phase of the sheet. The drive shaft (23) is actuated by a drive mechanism (50) comprising a clutch with a toothed pinion (62) having two discontinuities defining rest and stop positions of alignment coacting with a clutch and retaining lever (66) controlled by reverse rotation of the drive motor (58) of the printer. An advancing mechanism (54) permits effecting engagement of the toothed pinion (62) with an intermediate pinion (61) upon a clutch control. Actuating cams (106) permit pressing the support plate (12) of the sheets back to its rest position. This support plate (12) is subdivided into three portions resiliently urged by three springs (16) in the direction of the drive rolls (20).

19 Claims, 6 Drawing Sheets

DEVICE FOR FEEDING FLAT MATERIAL

FIELD OF THE INVENTION

The present invention relates to a device for feeding flat material to be treated, such as sheets and/or envelopes, for machines using these flat materials, comprising a supply chamber with a bottom and a front wall in which a stack of said sheet material is disposed and from which the sheets are extracted one by one and introduced into the machine, drive means arranged on a drive shaft so as to displace the flat material on the top of the pile to feed it into the machine, the device comprising moreover at least one retention member adapted to retain the flat material disposed in the pile below the highest sheet.

BACKGROUND OF THE INVENTION

Such devices are known for feeding sheets of papers used in printers, writing machines or other apparatus, such as photocopiers. These devices use very frequently as the retention member lateral retaining wedges from beneath which the upper sheet is extracted during its feeding. If the retaining wedges can be used with more or less success with relatively thin sheets of little rigidity, a use of sheets which are thicker and more rigid or envelopes, is not possible with this type of retaining member. It has also been noted that these retaining wedges leave marks on thin sheets during their extraction. In certain known devices, the retaining wedges have been mounted retractably by means of a control mechanism so as to be spaced apart during use of relatively rigid material. These retractable retaining wedges are however less practical and of a relatively high cost.

OBJECT OF THE INVENTION

The present invention has for its object to overcome this drawback and to provide a device permitting the feeding of flat material to be printed, of very different rigidities, from very thin paper to cardboard or envelopes, whilst being of simple and very low cost construction.

SUMMARY OF THE INVENTION

The invention is characterized to this end by the fact that the retaining member is constituted by a cut pile fabric arranged on the front wall of the supply chamber, the fibers of this material having a resistance to displacement adapted to retain the sheets by their forward edge and to permit the top sheet in the pile to be driven by the force of said drive members.

The action of the fibers of a material of the type of cut pile fabric permits obtaining an adequate retention effect and is adapted also to thin or thick sheets or even to envelopes, whilst providing a simple and very low cost construction.

Preferably, the front wall of the supply chamber comprises a plane inclined relative to the normal to the bottom, the fabric with fibers being constituted by strips of cut pile fabric secured on the inclined plane.

According to a preferred embodiment, said strips are secured in recesses in the inclined plane, the depth of the recesses being less than the length of the fibers such that these latter extend beyond the upper surface of the inclined plane to coact with the forward edge of said sheets.

By this arrangement, there is obtained a particularly reliable operation permitting a very effective separation of the top sheet whilst maintaining the subjacent sheets in the pile.

According to a preferred embodiment, the strips have a fiber density comprised between 5,000 and 30,000 fibers/cm$^2$, preferably 18,000 fibers/cm$^2$, the length of the fibers being comprised between 0.7 and 3 mm, preferably substantially equal to 1.5 mm, the fibers extending 0.2 to 1.5 mm beyond the upper surface of the inclined plane, preferably 0.5 mm.

The invention also simplifies and improves the selection of the upper sheet and the easy alignment of this sheet whilst keeping the construction of the device as simple as possible. It is characterized to this end by the fact that the drive members are constituted by at least one drive roller comprising on its periphery at least a first sector having a fairly high coefficient of friction to drive the uppermost sheet of the pile toward the machine and at least one second sector having a fairly low coefficient of friction to permit sliding of the selected highest sheet between the drive roll and the subjacent sheets of the pile during an alignment phase.

This particular construction of the drive rolls permits effective selection of the topmost sheet, whilst permitting alignment of this sheet in an ultimate phase without it being necessary to space the drive rolls from the selected sheet nor to provide other mechanisms or alignment members.

Preferably, the drive roller rolls comprise moreover a third sector whose external surface is sunken relative to the first and second sectors so as to constitute a free space for the loading of the stack of sheets.

According to a preferred embodiment, the drive roll or rolls are in the form of cams having a central elastomeric coating disposed between two lateral identical cams, the external surface of the coating of elastomer extending beyond, over the first sector of the roll, the external surface of the lateral cams to drive the topmost sheet, the external surface of the lateral cams extending beyond the external surface of the elastomer coating about the second and third sectors, the external surface of the lateral cams of the second sector being in contact with the highest sheet and the external surface of the lateral cams of the third sector being closer to the axis of the drive shaft than the external surface of the second sector.

By this arrangement, there is obtained a very effective and reliable construction of the drive rolls, facilitating the phases of loading the stack of sheets, delivering and aligning the top sheet.

The invention also relates to an improvement in the support plate on which the sheets to be fed are disposed and it is characterized to this end by the fact that this support plate is subdivided, at least in its portion situated facing the drive rolls, into three portions adapted to be displaced resiliently relative to each other, each of these portions being urged by a resilient element against a drive roll.

This arrangement permits correcting faults of alignment of the drive rolls or of the flatness of the support plate. The device moreover permits reliable feeding of flat material of different widths.

Preferably, the support plate is pivotally articulated on side walls of the supply chamber by means of two pivots engaged in longitudinal openings permitting displacement of the pivots perpendicular to the axis of the pivots.

The contact of the drive rolls with sheets of all dimensions can thus be greatly improved, permitting regular delivery and introduction.

The invention also relates to a simplification and improvement of the drive mechanism for the drive shaft engaging by means of at least one intermediate pinion with a drive motor. It is characterized to this end, by the fact that the drive mechanism comprises a clutch device comprising a tooth pinion whose teeth have two discontinuities, this discontinuous pinion being adapted to engage with the intermediate pinion, said discontinuities defining rest or stop positions when they are located opposite the intermediate pinion.

By this construction, there is obtained a simple and effective control of the rest and alignment positions of the drive shaft and its clutch and a very low cost.

According to a preferred embodiment, the clutch device comprises at least one lever for clutching and retention, adapted to coact with rest or stop abutments provided on the toothed pinion, the device comprising an advancing mechanism having an advancing lever urged resiliently against an advancement cam so as to bring the clutch and retention lever against rest or stop abutments, when said discontinuities of the toothed pinion are located opposite the intermediate pinion.

This construction ensures very reliable operation, whilst requiring only a small number of components.

Preferably, the device comprises a clutch control mechanism constituted by a helical spring carried by the intermediate pinion and having a free end adapted to coact with the clutch and retention lever during one reversed rotation of the drive motor so as to disengage the clutch and retention lever from one or the other of the rest or stop abutments and so as to free the toothed pinion such that this latter engages with the intermediate pinion under the influence of the advancing mechanism.

The operation of the clutch mechanism is thus effected in a reliable and uncomplicated manner.

According to a preferred modification, the device comprises a control lever of which a first portion is arranged so as to coact with the free end of said spring, of which a second portion is adapted to coact with the clutch and retention lever to displace this latter against the force of a resilient element during one control of the clutch and of which a third portion is adapted to coact with portions of the toothed pinion so as to brake this latter during a clutch control.

There is thus obtained a controlled and progressive clutching, whilst avoiding the generation of noise produced by sudden ratcheting.

Preferably, the toothed pinion is secured to the drive shaft, this latter being of one piece construction with at least one actuating cam arranged so as to push back the support plate for the sheets against the force of resilient elements into the rest position, with said advancing cam, with at least one portion of the drive members and with guide elements for the sheets.

This construction permits a very precise production at low cost of the drive shaft and of its associated elements, for example of molded plastic.

According to the present invention, in a rest position, the sheets are loaded into the supply chamber, the drive shaft is clutched by reverse rotation of the drive motor, the support plate is urged in the direction of the drive members, which, driven by reverse rotation of the drive motor, feed by means of a first sector with high coefficient, the top sheet from the pile in the direction of said machine, an alignment of the sheet in a stop position of the drive shaft is effected by reverse rotation of the drive motor, the drive members braking, by means of a second sector with a coefficient of friction lower than the first sector, said sheet, the support plate is moved away from the drive members to return to the rest position, all of this cycle taking place during one rotation of the drive shaft.

This permits a very reliable selection and feeding of sheets whilst comprising a reduced number of successive operations.

The present invention also relates to an auxiliary sheet stop adapted to stop the sheets that are longer than the supply chamber and is characterized in that this sheet stop is constituted by a blade having an elongated slot, a retention member engaged in the slot being secured to the rear wall of the bottom and comprising a head of a larger diameter than the width of the slot, the rear wall having a projecting portion along which the plate can be slid, the plate being shaped so as to be adapted to be turned through a predetermined angle about the retention member to be displaced from a retracted position toward an active position and vice versa.

By this construction, there is obtained a retractable auxiliary sheet stop from a very reduced number of components, which can be rapidly assembled, reliable in operation and very low in cost.

BRIEF DESCRIPTION OF THE DRAWINGS

Other advantages will become apparent from the explanatory description hereafter of the invention in greater detail with reference to the drawings which show schematically and by way of example one embodiment, and in which.

DETAILED DESCRIPTION OF THE INVENTION

Figure 1:
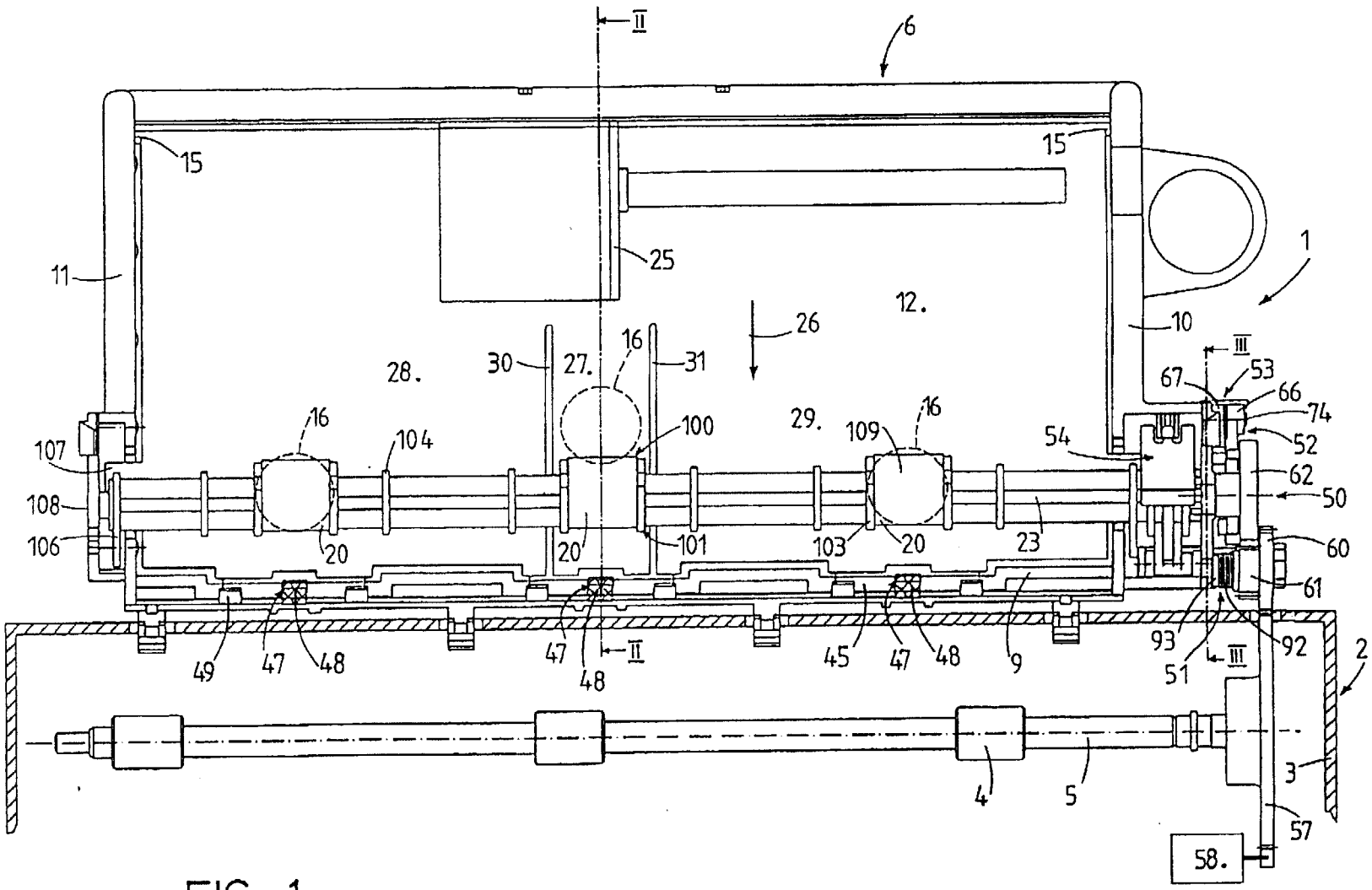
FIG. 1 is a front view of the feeding device and a portion of the printer on which the device is mounted.

The feeding device 1 shown in FIG. 1 is mounted removably on a printer 2 of which only a portion of the frame 3, the transport rolls 4, the transport shaft 5 and the drive motor 58 are shown. The device 1 could of course also be fixedly secured to the printer, to a writing machine or any other apparatus using flat material such as sheets of paper, cardboard or envelopes. The device 1 comprises a supply chamber 6 with a bottom 8 (FIG. 2A), a forward wall 9, two fixed side walls 10 and 11, and a support plate 12 on which a stack 14 of sheets, envelopes or any other flat material can be disposed.

The support plate 12 is pivotally mounted on the side walls 10, 11 by means of two pivots 15 engaged in longitudinal openings 17 permitting transverse adjustment of the axis of the pivots 15. Three springs 16 urge the support plate 12 in the direction of the drive rolls 20 mounted on a drive shaft 23.

This support plate 12 comprises a movable lateral guide 25 for sheets mounted slidably on the support plate 12 in a direction perpendicular to the direction of feeding of the sheets indicated by the arrow 26. The guide 25 serves as a lateral bearing permitting the suitable feeding of all flat materials, sheets or envelopes, of different sizes. The width of the feeding device can thus be adapted to different formats of flat material to be fed.

The support plate 12 is moreover subdivided in its lower half into three portions 27, 28, 29 separated by slots 30 and 31, each portion being urged individually by one of the springs 16 in the direction of a drive roll 20. As the support plate 12 is made of resilient material, for example plastic material, each portion 27, 28, 29 can be displaced relative to the adjacent portions. Thus, there is obtained a substantially identical application force of the material to be fed against the drive rolls 20 and hence a regular displacement of the material to be fed for any width and thickness of this material.

Figure 7:
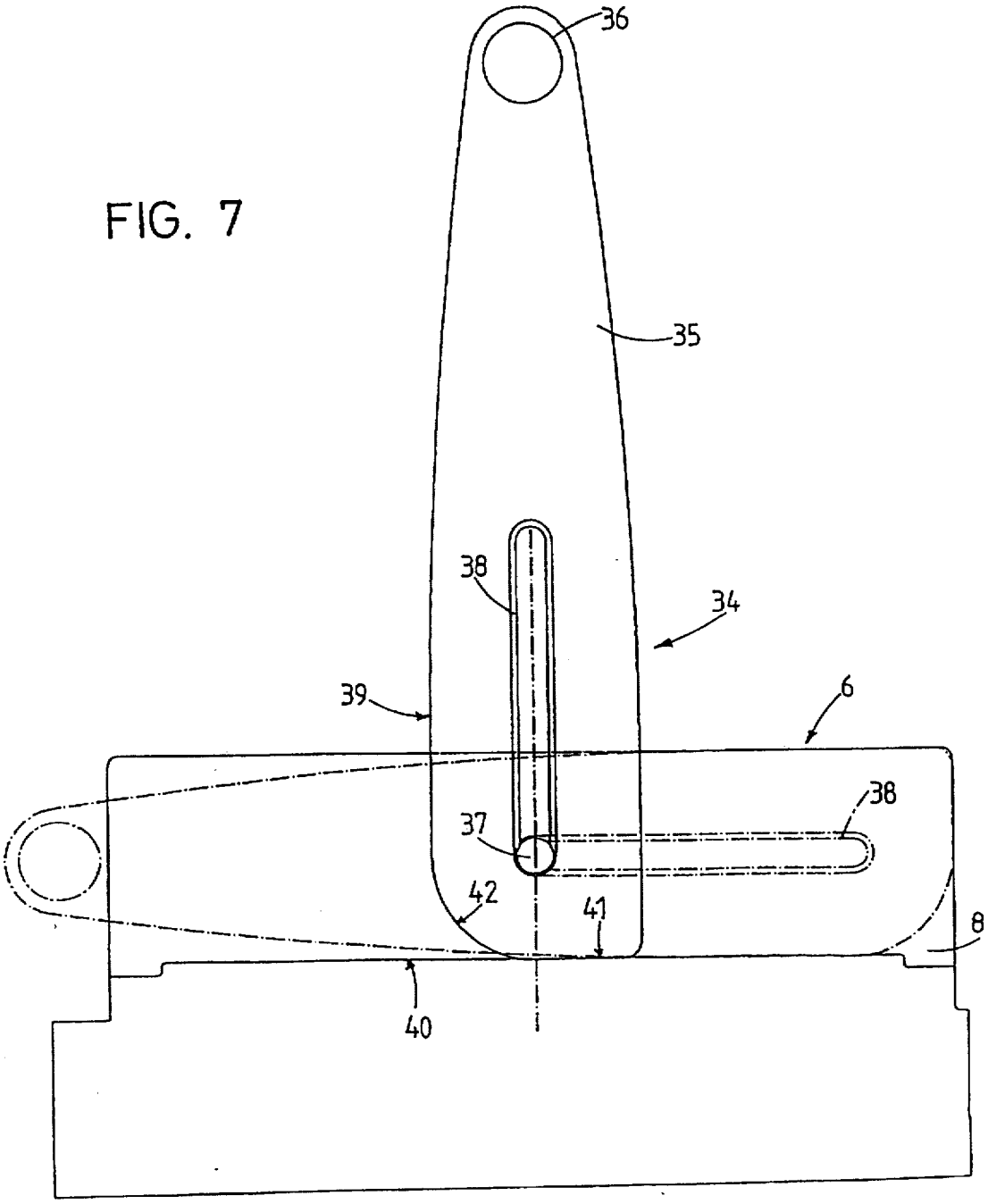
FIG. 7 is a view of the rear surface of the device.

Referring to FIG. 7, the rear surface of the bottom 8 of the supply chamber 6 is provided with a retractable auxiliary sheet stop 34 adapted to serve as a stop for the upper portion of sheets of large size. This sheet stop 34 is present in the form of an oblong blade 35 comprising at its free end an opening 36 serving for its gripping. A retaining element in the form of a lug 37 secured to the rear surface of the bottom 8 of the supply chamber is engaged in an elongated slot 38 of the plate 35. As the head of the lug 37 has a greater diameter than the width of the slot 38, the plate 35 is retained against the rear surface of the bottom 8, but can slide in a direction parallel to the slot 38 along a projecting portion 40 provided on the rear surface of the bottom 8.

When it is desired to move the sheet stop 34 from the retraction position shown in broken lines in FIG. 7, the lateral edge 39 of the plate 35 is slid along the projecting portion 40 to the left. When the lug 37 reaches the right end of the slot, it suffices to turn the blade 35 by 90° upward. In this position, the plate 35 rests by its lower edge 41 on the projecting portion 40. To permit rotation of the plate 35, the lower edge 41 of this latter has a rounded corner 42 which is quarter circular having its center coinciding with the center of the lug 37. This particular arrangement of the sheet stop assures reliable operation whilst requiring a minimum of components, thereby permitting a very low cost.

Figure 2C:
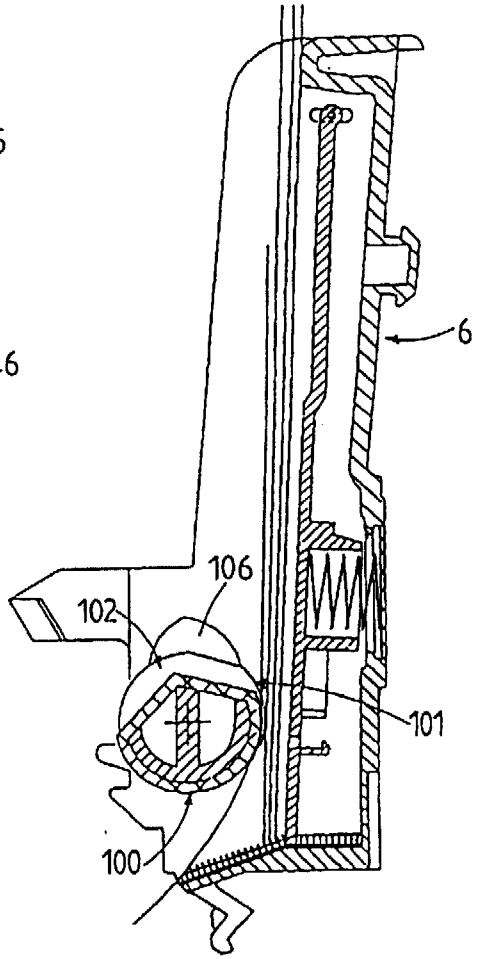
FIGS. 2A, 2B and 2C show transverse cross-sectional views of the device along the line II—II of FIG. 1, in three positions: 2A in the rest position, 2B during selection of the sheet, 2C during alignment of the sheet.
Figure 2B:
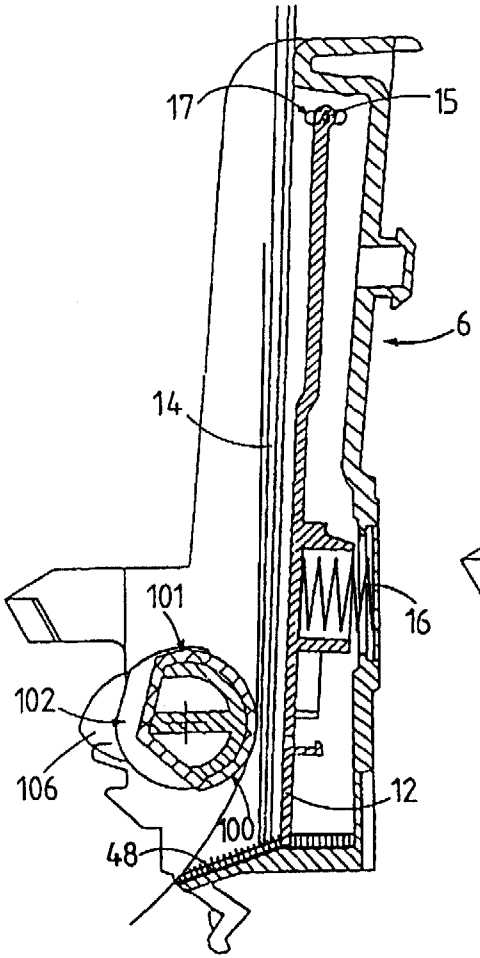
Figure 2A:
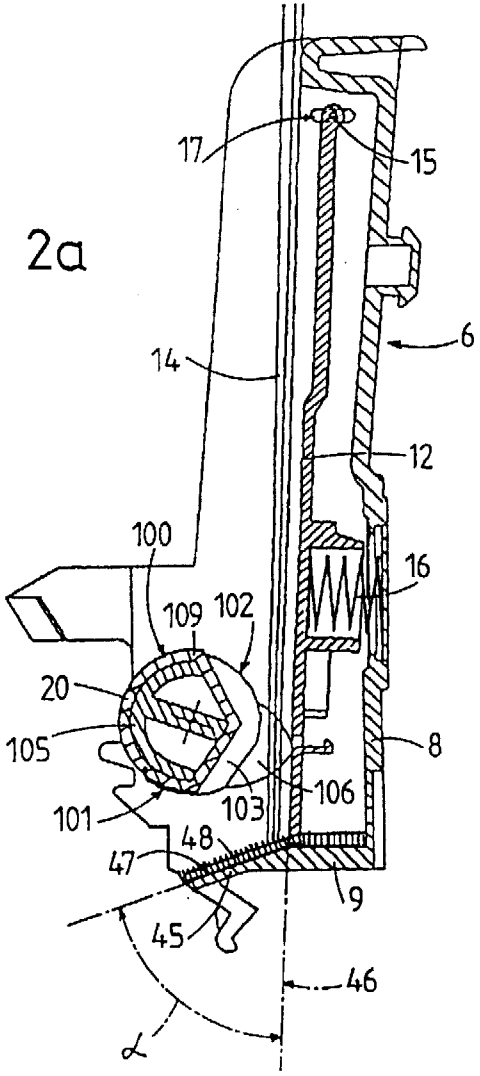

Referring to FIGS. 1 and 2A, the front wall 9 of the supply chamber has an inclined plane 45 forming a predetermined angle $\alpha$ with a plane 46 parallel to the lower portion of the bottom 8 of the supply chamber. This angle is preferably selected between 50° and 85° and more preferably between 60° and 80°. In the arrangement shown in FIG. 2A, it is equal to 71°. The inclination of this plane 45 relative to the rear portion of the forward wall 9 is thus between 5° and 40° and in FIG. 2A is equal to 19°.

The inclined plane 45 comprises three recesses 47 in which are cemented three strips 48 of a fiber material, such as a cloth of the cut pile type. The depth of the recesses 47 is such that the upper portion of the fibers of the strips 48 is exposed above the upper surface of the inclined plane 45 so as to coact with the forward edge of the sheets or flat material to be fed and to retain these materials whose forward edge enters between the fibers of the strips to constitute retention members. The strips 48 have resistance to displacement of a sheet which is a function of the material of the fibers used, their diameter, their length, their density and the depth of penetration of the forward edge of the sheet. Strips of a width of 5 mm having a density of 18,000 fibers/cm$^2$ of a length of 1.5 mm give excellent retention effect, when these fibers extend by 0.5 mm above the upper surface of the inclined plane 45.

As can be seen in FIG. 1, the strips of fibers 48 are located in the inclined plane 45 in positions located opposite the drive rolls 20. When these latter are driven, the uppermost sheet in the stack is displaced and disengaged from the fibers (FIG. 2B), whilst the following sheet and the others are retained in place by the fibers of the strips 48 without it being necessary to provide lateral retention wedges, as is the case in the majority of the known feeding devices. It is moreover also possible to provide the front edge of the inclined plane 45 with leaf springs mounted in six openings 49 provided in the inclined plane 45 and serving as supplemental retention elements.

Referring to FIGS. 1 to 5, the feeding device comprises a drive mechanism 50 very special to the drive shaft 23. This drive mechanism 50 includes a clutch control member 51 connected with a clutch mechanism 52 associated with an antinoise mechanism 53 and coacting with an advancing mechanism 54.

The drive mechanism 50 is actuated by a pinion 57 secured to the transport shaft 5 of the printer and in engagement with a drive motor 58 of the printer. Of course the feeding device 1 could also be driven by a motor individual to the feed device.

The pinion 57 is in engagement with a first pinion 60 of the clutch control member 51. This first pinion 60 is secured to a second pinion 61 adapted to coact with the teeth of a toothed pinion 62 secured to the end of the drive shaft 23. This toothed pinion 62 comprises two discontinuous sectors 63 and 64 without teeth. When one or the other of these two sectors 63, 64 faces the second pinion 61, the drive shaft is not driven, but maintained in position by the retaining and clutch mechanism 52.

Figure 4:
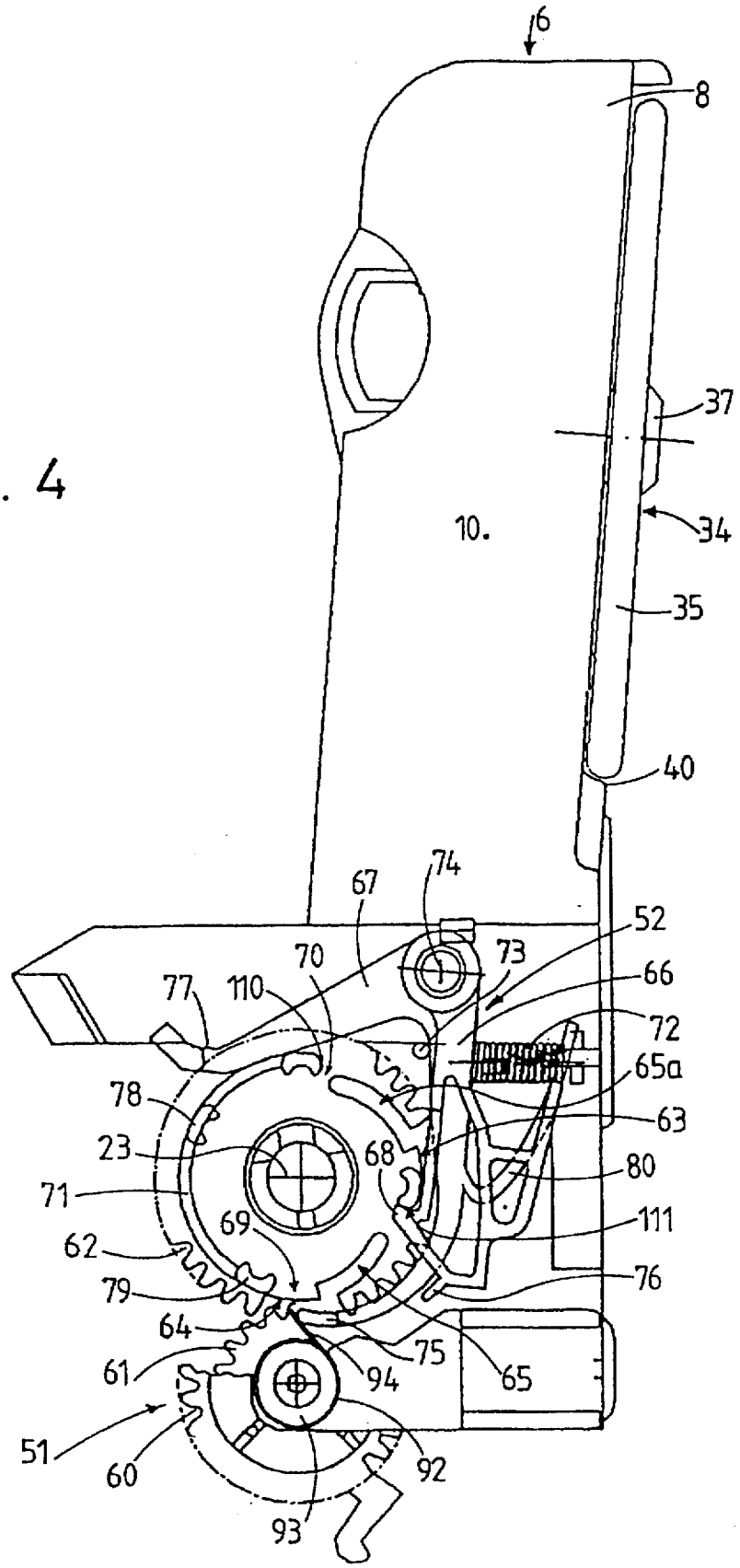
FIG. 4 is a side view of the right surface of the device of FIG. 1.
Figure 5:
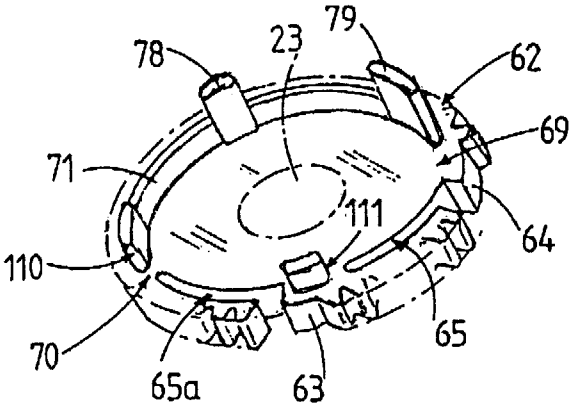
FIG. 5 is a view of a detail of FIG. 4.

As shown in FIGS. 4 and 5, the toothed pinion 62 comprises two openings 65 and 65*a* in the form of a segment of a circle arranged below the teeth and prolonging the toothless sections 63, 64 in the direction turning to the left in FIG. 4. These two openings 65, 65*a* impart to the teeth below which they are located a radial resiliency permitting easy engagement of the toothed pinion 62 with a second pinion 61, even if two teeth of these two pinions 61, 62 are opposed during clutch engagement of the toothed pinion 62.

The retention and clutching mechanism 52 comprises a first and a second lever 66, 67 mounted pivotally on the supply chamber via a pivot 74.

With reference to FIGS. 4 and 5, the first lever 66 serves as a blocking lever. It comprises an end having a retention tooth 68 adapted to coact with two openings 69, 70 provided in a cylindrical skirt 71 secured to the toothed pinion 62. This first lever 66 is urged by a spring 72 against this skirt 71 such that its retention tooth 68 slides on the external surface of the skirt 71 and enters into one or the other of the openings 69, 70 to stop the toothed pinion 62 against its edges 111 and 110 and to maintain it when one or the other of the two toothless sectors 63, 64 is located opposite the second pinion 61. In this position, the first lever 66 is moreover in contact with a fixed abutment 73 secured to the supply chamber 6. The first lever 66 is controlled by the second lever 67 which comprises a first end 75 coacting with the clutch control member 51 and with a lateral prolongation 76 of the first lever 66 to displace this latter against the action of the spring 72 and to disengage the retention tooth 68 from one or the other of the openings 69, 70. A second end 77 of the second lever 67 is adapted to coact with two prolongations 78, 79 of the skirt 71 of the toothed pinion 62 so as to brake this latter. In rest position, the second lever 67 is urged by an elastic hooked portion 80 against the fixed abutment 73.

With reference to FIG. 4, the clutch control member 51 is in the form of a clutch spring 92 wound about a shaft 93 secured to the pinions 60 and 61. This spring 62 comprises at one of its ends a rectilinear blade 94 adapted to coact during a reverse rotation of the drive motor 58 with the first end 75 of the second lever 67 such that this latter will slide on the first lever 66 to disengage the retaining tooth 68 from one or the other of the openings 69, 70 and to engage the drive of the drive shaft 23, when the first and second pinion 60, 61 are in rotation in the direction to the right in FIG. 4 corresponding to reverse rotation of the drive motor 58.

When the pinions 60, 61 turn in a direction to the left corresponding to forward rotation of the motor 58, the blade 94 abuts the end 75 of the second lever 67 without however acting on this latter.

Figure 3C:
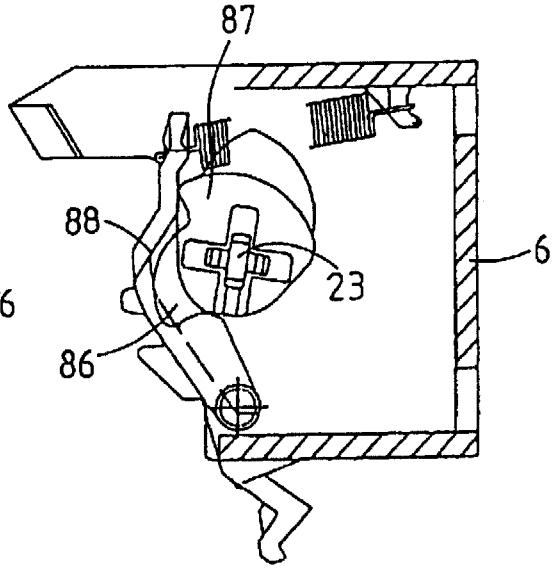
FIGS. 3A, 3B and 3C show views in transverse cross section of the device along the line III—III of FIG. 1 in three positions: 3A in the rest position, 3B during selection of the sheets, 3C during alignment of the sheet.
Figure 3B:
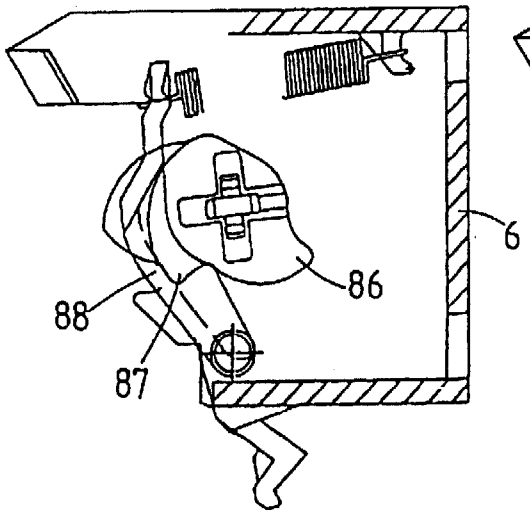
Figure 3A:
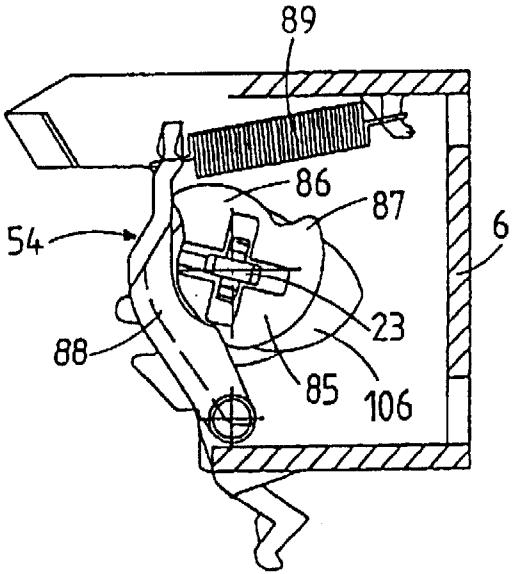

With reference to FIG. 3A, the advancing mechanism 54 comprises a cam 85 secured to the drive shaft 23 and having two projecting sectors 86, 87. An advancing lever 88 is mounted pivotally on the supply chamber 6 and urged by a spring 89 against the cam 85. The spring 89 is mounted between the free end of the advancing lever 88 and the supply chamber 6. The cam 85 is arranged so as to urge the drive shaft 23 in rotation in a clockwise direction in FIG. 3A, when the drive shaft is located in a position such that one or the other of the toothles sectors 63, 64 of the toothed pinion 62 is facing the second pinion 61 and in which the toothed pinion 62 is therefore not driven by the second pinion 61, but blocked by the blocking lever 66.

Figure 6:
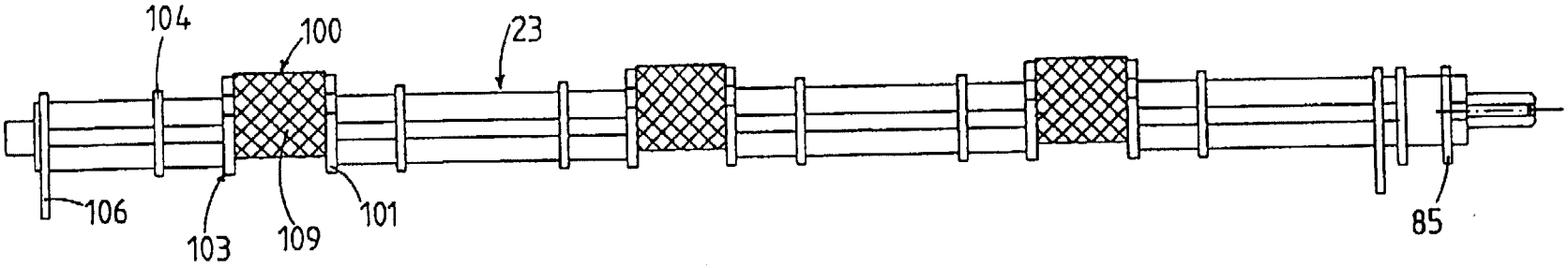
FIG. 6 is a plan view of the drive shaft.

Referring to FIGS. 1, 2A and 6, the drive rolls 20 are in the form of cams and comprise three sectors. A first sector 100 has a sufficiently high coefficient of friction to effect the separation and feeding of the top sheet of the stack of sheets, a second sector 101 with a sufficiently low coefficient of friction to permit sliding of this sheet during an alignment phase during its introduction into the printer and a third sector 102 presenting an opening for the loading of the sheets. The high coefficient of friction sector 100 is constituted by a central cladding of elastomer 109 applied on a support 105 bounded by two cams 103 of plastic material of lower coefficient of friction constituting the second and the third sectors 101 and 102. Seen in cross section, the external surface of the elastomeric cladding 109 extends beyond the cams 103 of plastic material about a sector of substantially 180° to enter into contact with the top sheet (FIG. 2B).

Along the sector 101, the cams 103 extend beyond the elastomeric coating 109 to enter into contact with the sheet. About the sector 102, the cams 103 are flattened to form said opening and the elastomeric cladding 109 occupies a withdrawn position.

The drive shaft 23 also comprises six circular surfaces 104 of a radius equal to or less than the smallest radius of the drive rolls 20. These circular surfaces 104 are adapted for guiding the sheets between the transport rolls.

Finally, the drive shaft 23 is secured at each of its sides to an actuating cam 106 adapted to coact with two lateral prolongations 107 of the support plate 12 to push back this latter into the rest position for loading of the sheets (FIG. 2A).

Referring to FIG. 6, the drive shaft 23 is constituted of injection molded plastic and is of one piece with the cams 103, with the supports 105 (FIG. 2A) for the elastomeric cladding 109, with the six circular guide surfaces 104, with the two actuating cams 106 to press back the support plate 12 and with the advancing cam 85 divided into two parallel cams. This shaft 23 is guided in two bearings 108 (FIG. 1) of the supply chamber 6 and is secured to the toothed pinion 62.

The operation of the feeding device is as follows. In the rest position shown in FIGS. 2A and 3A, the actuating cam 106 coacts with the support plate 12 to press it back. A stack of sheets 14 can be loaded into the supply chamber 6. The sheets are retained at their forward edge by the retention strips 48 having fibers. The cams 103 with a low coefficient of friction of the drive rolls 20 are spaced from the top sheet. The projecting portion 86 of the advancing cam 85 (FIG. 3A) coacts with the advancing lever 88, which urges the drive shaft 23 in a direction of rotation to the right. The drive shaft 23 is however retained stationary by the lever 66 (FIGS. 4 and 5) whose tooth 68 is inserted in the opening 70 provided in the skirt 71. The tooth 68 of lever 66 abuts in fact against the left edge 110 of this opening 70 and retains the drive shaft 23 against the force exerted by the advancing lever 88 on the advancing cam 85. The first discontinuity 63 of the toothed pinion 62 is located facing the second pinion 61.

Upon the command to feed a sheet, the motor 58 of the printer is placed in rotation in a direction opposite to the advance of the paper. The pinions 60 and 61 then turn in a direction to the right such that the straight blade 94 of the clutch spring 92 (FIG. 4) enters into contact with the end 75 of the lever 67. As the turns of this spring 92 are wound up by a rotation to the right of the shaft 93 on which they are rolled, the rectilinear blade displaces the lever 67 to the left about the pivot 74, and the lever 67 drives the lever 66 by means of the lateral prolongation 76 in its movement of rotation to the left.

The tooth 68 of the lever 67 is thus disengaged from the edge 110 of the opening 70 and the toothed pinion 62 and the shaft 23 are placed in rotation to the right under the influence of the advancing lever 88. This rotation is braked by the second end 77 of the second lever 67 entering into contact with the prolongation 79 of the toothed pinion 62, which permits clutching and braked and progressive engagement of the toothed pinion 62 with the second pinion 61 thereby avoiding generating noise. The lever 67, coacting by braking with the toothed pinion 62, thus constitutes the antinoise mechanism 53.

The engagement of the toothed pinion 62 with the second pinion 61 takes place in an adequate manner because of the radial elasticity of the teeth on the toothed pinion adjacent the clutch wheel thanks to the opening **65*a*** provided below the teeth.

The motor 58 is then rotated in the direction of rotation corresponding to advance of the sheet transport. The pinions 60 and 61 turn in a direction to the left and the toothed pinion 62 and the drive shaft in a direction to the right.

Referring to FIG. 2B, the projections of the actuating cams 106 are disengaged from the support plate 12 and the stack of sheets 14 is applied by the springs 16 against the drive rolls 20. The sector 100 with high coefficient of friction of the elastomeric coating 109 enters into contact with the top sheet of the stack 14 and disengages this sheet from the fibrous retention strips 48, whilst the other subjacent sheets remain retained. The selected sheet is then gripped between the transport rolls 4 of the printer turning in the direction of advance of the sheet. After a rotation of substantially 230° of the drive shaft 23 from the rest position, the sector 101 with a lower coefficient of friction of the cams 103 enters into contact with the top sheet which is then no longer advanced by the drive rolls 20 (FIG. 2C).

After a rotation of substantially 270° of the drive shaft, the second toothless sector 64 of the toothed pinion 62 is located facing the second pinion 61, whilst the projecting sector 87 of the advancing cam 85 coacts with the advancing lever 88 to turn the drive shaft 23 in a direction to the right in FIG. 3C. At this moment, the tooth 68 of the lever 66 enters under the force of the spring 72 into the opening 69 of the skirt 71 of the toothed pinion 62, such that the rotation of the toothed pinion 62 will be stopped given that the tooth 68 enters into abutment against the edge 111 of the opening 69.

There then follows an alignment phase, during which the direction of rotation of the motor 58 is reversed to retract the selected sheet until its forward edge is no longer gripped between the transport rolls 4 of the printer, but rests on the contact zone between the transport rolls 4.

This rearward transport of the selected sheet is made possible by the low coefficient of friction of the sector 101 of the drive rolls 20. If the selected sheet is gripped obliquely between the transport rolls 4 of the printer, it is aligned perfectly by the reverse transport movement.

During this rearward transport movement to align the sheet, the pinions 60, 61 are driven in a direction to the right in FIG. 4. At the end of this movement, the rectilinear blade 94 of the clutch spring 92 (FIG. 4) enters therefore again into contact with the end 75 of the lever 67 which is rotated to the left about the pivot 74. It carries in rotation with itself the lever 66 whose tooth 68 disengages from the edge 111 of the opening 69. The drive shaft 23 being urged in rotation to the right by the advancing lever 88, the engagement of the teeth of the toothed pinion 62 and of the pinion 61 takes place in a controlled manner under the influence of the antinoise braking due to the action of the end 77 of the lever 67 on the prolongation 78 of the skirt 71 of the toothed pinion. This engagement is moreover facilitated by the radial elasticity of the teeth of the toothed pinion resulting from the opening 65 provided below the teeth of the toothed pinion.

After this alignment phase, the motor 58 is driven in rotation in the direction to transport the sheets, the drive shaft 23 is rotated to the right. Referring to FIGS. 2C and 2A, the actuating cam 106 presses back the support plate 12 to the rear to space the stack of sheets 14 from the drive rolls 20, whilst the selected sheet is advanced by the transport rolls 4 of the printer.

Simultaneously, the toothless sector 63 of the toothed wheel 62 arrives opposite the second pinion 61 and the tooth 68 of the lever 66 falls under the influence of the spring 72 into the opening 70 of the skirt 71. The drive shaft 23 is at this moment urged in rotation to the right by the action of the advancing levers 88 on the projecting sector 86 of the advancing cam 85 such that the tooth 68 of the lever 66 will be urged against the edge 110 of the opening 70 of the skirt 71. This position therefore corresponds again to the initial rest position during which the printing of the selected sheet is effected.

In short, a selection and introduction of a sheet is carried out in the following manner:

- clutching of the feeding device by reverse rotation of the motor 58,
- drive of the top sheet by the drive rolls 20 by forward rotation of the motor 58,
- unclutching the feeding device,
- alignment of the sheet by rearward rotation of the motor 58 followed by clutching of the feeding device,
- disengagement of the support plate and unclutching of the feeding device by forward rotation of the motor 58.

This arrangement of the feeding device permits very reliable separation of the top sheet, whilst comprising a small number components, and can thus be produced at very low cost.

The strips of material with fibers 48, of the cut pile type, confer an excellent retaining effect on the sheets stacked in the supply chamber 6, whilst permitting easy separation of the top sheet.

The drive rolls 20 with two coefficients of friction ensure reliable separation of the top sheet and serve at the same time as guide elements during the alignment phase of the selected sheet.

The support plate 12 divided along a portion of its height into three portions 27, 28, 29, permits regular application of the sheets against the drive rolls 20 over all the width of these sheets.

The feeding device comprises only a single transverse shaft formed of one piece with the transport rolls 20, the actuating cams 106 to control the movement of the support plate 12 and the advancing cam 85 permitting the engagement of the device during clutching. Given that this shaft can be made by injection molding of plastic, the production and mounting of this piece is very easy and low cost.

The toothed pinion 62 associated with the two levers 66, 67 permits because of its sophisticated construction a reliable control of the various movements of rotation of the drive shaft whilst giving to the device a silent operation.

The combination of the operations of selection and alignment of the sheets is achieved thanks to two reversals of the direction of rotation of the drive motor 58 of the printer.

The device also has a retractable sheet stop 34 which is of a single piece and of simple and reliable operation, whilst being of low cost.

This construction moreover permits production of almost all the constituent elements by plastic injection molding, which renders possible a very low cost. The small number of these constituent elements ensures very rapid and uncomplicated assembly and repair.

Of course the embodiment described above is not limiting and can be the subject of any desired modification. In particular, the strips 48 can be constituted by any material having straight, curved or hooked fibers adapted to retain sheets. Their size and number can be selected as a function of the uses of the feeding device.

The drive shaft could comprise a different number of drive rolls and the elastomeric surfaces of these latter could be replaced by surfaces of plastic material comprising transverse grooves adapted to drive the sheet.

Instead of being controlled by reversal of motor 58, the clutching of the drive shaft could be constituted by any other mechanical or electrical element, for example by means of an electromagnet.

The support plate 12 instead of being subdivided into three portions could comprise also another number of portions adapted to be displaced relative to each other.

The sheet feeding device could of course be used for any machine using flat material, such as printers, printing machines, copiers, scanners, etc.

I claim:

1. In a device for feeding flat material to a machine using this flat material, comprising a supply chamber with a bottom and a front wall in which a stack of said flat material is adapted to be disposed and from which the flat material is withdrawn one by one and introduced into the machine, drive means disposed on a drive shaft so as to displace the top flat material from the stack to feed it into the machine, the device comprising moreover at least one retaining member adapted to retain the flat material disposed in the stack below the top material; the improvement wherein the retaining member is constituted by a material with fibers arranged on the front wall of the supply chamber, the fibers having a resistance to displacement adapted to retain the flat material by its forward edge and permitting the top flat material in the stack to be driven by said drive means, the front wall of the supply chamber comprising an inclined plane relative to a normal to the bottom, the material with fibers being constituted by strips of cut pile fabric secured in recesses in the inclined plane, the depth of the recesses being less than the length of the fibers such that the fibers extend beyond the upper surface of the inclined plane to coact with a forward edge of said flat material.

2. A device according to claim 1, wherein the strips (48) have a fiber density comprised between 5,000 and 30,000 fibers/cm$^2$, the length of the fibers being comprised between 0.7 and 3 mm, the fibers extending from 0.2 to 1.5 mm beyond the upper surface of the inclined plane (45).

3. A device according to claim 1, wherein the strips (48) are arranged on the inclined plane (45) facing said drive means (20).

4. In a device for feeding flat material (14) to a machine (2) using this flat material, comprising a supply chamber (6) with a bottom (8) in which a stack (14) of said flat material is disposed on a movable support plate (12) and from which the flat material is withdrawn one by one and fed into said machine (2), lateral drive rolls (20) and at least one intermediate drive roll (20) arranged on a drive shaft (23) so as to displace the top flat material from the stack to feed it into the machine (2), the device moreover comprising at least one retaining member (48) adapted to retain the flat material disposed in the stack below the top flat material, and at least one resilient element (16) to urge the movable support plate (12) in the direction of the drive rolls (20); the improvement wherein the support plate (12) is subdivided, at least in its portions situated opposite the drive rolls (20), into three portions (27, 28, 29) adapted to be resiliently displaced relative to each other, each of these portions being urged by a resilient element (16) against a drive roll.

5. A device according to claim 4, wherein the support plate (12) is of a plastic material and comprises three portions (27, 28, 29) separated by two slots (30, 31) extending over a portion of the height of the support plate (12), each portion being urged by a spring (16) in the direction of a drive roll (20).

6. A device according to claim 4, wherein the support plate (12) is articulated to pivot on two lateral walls (10, 11) of the supply chamber (6) by means of two pivots (15) engaged in longitudinal openings (17) permitting displacement of the pivots (15) perpendicular to the axis of the pivots.

7. In a device for feeding flat material (14) to a machine (2) utilizing this flat material, comprising a supply chamber (6) with a bottom (8) in which a stack (14) of said flat material is disposed on a movable support plate (12) and from which the flat material is withdrawn one by one and fed to said machine (2), drive members (20) arranged on a drive shaft (23) so as to displace the top flat material of the stack to feed it into the machine (2), the device comprising moreover at least one retaining member (48) adapted to retain the flat material disposed in the stack below the top flat material, and a drive mechanism (50) for the drive shaft (23) engaging by means of at least one intermediate pinion (60,61) with a drive motor (58); the improvement wherein the drive mechanism (50) comprises a clutch device (52) comprising a toothed pinion (62) whose teeth have two discontinuities (69, 70), this toothed pinion (62) being adapted to engage with the intermediate pinion (61), said discontinuities (69, 70) defining rest or stop positions when they are located opposite the intermediate pinion (61).

8. A device according to claim 7, wherein the drive members are constituted by at least one drive roll (20) comprising about its periphery at least one first sector (100) having a high coefficient of friction to drive the top flat material from the stack toward the machine (2) and at least a second sector (101) having a lower coefficient of friction to permit sliding of the selected top flat material between the drive roll (20) and the subjacent flat material of the stack (14) during an alignment phase of the flat material.

9. A device according to claim 8, wherein the drive rolls (20) comprise moreover a third sector (102) whose external surface is recessed relative to the first and second sectors (100, 101) so as to constitute a free space for the loading of the stack (14) of flat material.

10. A device according to claim 9, wherein the drive rolls (20) are in the form of cams having a central elastomeric cladding (109) disposed between two identical lateral cams (103), the external surface of the elastomeric cladding (109) extending about the first sector of the roll (20) beyond the external surface of the lateral cams (103) to drive the top flat material, the external surface of the lateral cams (103) extending beyond the external surface of the elastomeric cladding about the second and third sectors (101, 102), the external surface of the lateral cams (103) of the second sector (101) being in contact with the top flat material and the external surface of the lateral cams (103) of the third sector (102) being nearer the axis of the drive shaft (23) than the external surface of the second sector (101).

11. A device according to claim 7, wherein the clutch device (52) comprises at least one clutch and retaining lever (66) adapted to coact with rest or stop abutments (110, 111) provided on the toothed pinion (62), the device comprising an advancing mechanism (54) having an advancing lever (88) resiliently urged against an advancing cam (85) so as to bring the clutch and retaining lever (66) against rest or stop abutments (110, 111) when said discontinuities (69, 70) of the toothed pinion are located facing the intermediate pinion (61).

12. A device according to claim 11, which further comprises a clutch control mechanism (51) constituted by a helical spring (92) carried by the intermediate pinion (61) and having a free end (94) adapted to coact with the clutch and retaining lever (66) during reverse rotation of the drive motor (58) so as to disengage the clutch and retaining lever (66) from one or the other of the rest or stop abutments (110, 111) and so as to free the toothed pinion (62) so that the toothed pinion (62) engages with the intermediate pinion (61) under the force of the advancing mechanism (54).

13. A device according to claim 12, which further comprises a control lever (67) of which a first portion (75) is arranged so as to coact with said free end (94) of said spring (92), and of which a second portion is adapted to coact with the clutch and retaining lever (66) to displace the clutch and retaining lever (66) against the force of a resilient element (72) during a clutch control and of which a third portion (77) is adapted to coact with portions (78, 79) of the toothed pinion (62) so as to brake the toothed pinion (62) during a clutch control.

14. A device according to claim 11, wherein the toothed pinion (62) is secured to the drive shaft (23), the drive shaft (23) being made of one piece with at least one actuating cam (106) arranged so as to press back a support plate (12) for sheets against the force of resilient elements, into a rest position, with said advancing cam (85), with at least one portion of the drive members (20) and with guide elements (104) for sheets.

15. A device according to claim 11, wherein the drive members (20), the cams (85, 106) and the toothed pinion (62) are arranged on the drive shaft such that in a rest position, a first projecting portion (86) of the advancing cam (85) will be resiliently urged by the advancing lever (88), a first abutment (110) of the toothed pinion (62) will be in engagement with the clutch and retention lever (66), a first discontinuity (63) of the toothed pinion will be opposite the intermediate pinion (61), a projection from the actuating cam (106) presses back the support plate (12) distancing it from the drive members (20), a third sector (102) of the drive members (20) whose external surface is recessed relative to a first sector and a second sector (100, 101) will be disposed opposite the stack of flat material (14), in a first portion of a drive phase after disengagement of the clutch and retaining lever (66) from the first abutment (110) by reverse rotation of the drive motor (58) the advancing cam (85) is driven by the advancing lever (88), the teeth of the toothed pinion (62) engage with the intermediate pinion (61), the projection of the actuating cam (106) will be disengaged from the support plate (12), the first sector (100) with a higher coefficient of friction than the second sector (101) of the drive members (20) will be in contact with the stack of flat material (14), in a second portion of the drive phase the first sector (100) of the drive members (20) drives the top flat material disengaging it from said retaining members (48) by forward rotation of the drive motor (58), in a stop and alignment phase, a second projection (87) of the advancing cam (85) will be urged resiliently by the advancing lever (88), a second abutment (111) of the toothed pinion (62) will be in engagement with the clutch and retaining lever (66), the second discontinuity (64) of the toothed pinion (62) will be facing the intermediate pinion (61), the second sector (101) of the drive members (20) will be in contact with the stack of flat material (14), permitting the alignment of the top flat material by sliding, in a first portion of a final phase after disengagement of the clutch and retaining lever (66) from the second abutment (111), by reverse rotation of the drive motor (58), the advancing cam (85) will be driven by the advancing lever (88), the teeth of the toothed pinion (62) engage with the intermediate pinion (61), and in a second portion of the final phase, the projection of the actuating cam (106) pushes back the support plate (12) by forward rotation of the drive motor until the drive shaft occupies the rest position.

16. A device according to claim 7, wherein the toothed wheel (62) comprises two openings (65, 65*a*) in the form of segments of a circle arranged below the teeth of the toothed pinion (62) and prolonging toothless sections (63, 64) of the toothed pinion (62), these openings (65, 65*a*) being adapted to impart to the toothing below which they are located a radial elasticity so as to facilitate engagement of the toothed pinion (62) with the intermediate pinion (61).

17. In a device for feeding flat material (14) to a machine (2) using this flat material, comprising a storage chamber (6) with a bottom (8) in which a stack (14) of said flat material is disposed and from which this flat material is withdrawn and fed to the machine (2), the bottom (8) of the supply chamber (6) being provided with an auxiliary sheet stop (34) adapted to serve as a stop for the flat material (14) exceeding in length the supply chamber (6); the improvement wherein this sheet stop (34) is constituted by a plate (35) having an elongated slot (38), a retaining member (37) engaged in the slot (38) and being secured to a rear wall of the bottom (8) and comprising a head with a diameter larger than the width of the slot (38), the rear wall having a projecting portion (40) along which the plate (35) can slide, the plate (35) being shaped so as to be adapted to be turned through a predetermined angle about the retaining member (37) to be brought from a retracted position to an active position and vice versa.

18. A device according to claim 17, wherein the plate (35) comprises a lateral edge (39) coacting in the retracted position with the projecting portion (40) and which is adapted to slide along this projecting portion (40), a lower edge (41) adapted to rest on the projecting portion (40) in the active position, and said a rounded corner (42) of a quarter circle connecting said lateral edge (39) and lower edge, said quarter circle having its center substantially coinciding with the center of the retaining member (37).

19. In a device for feeding flat material to a machine using this flat material, comprising a supply chamber with a bottom and a front wall in which a stack of said flat material is adapted to be disposed and from which the flat material is withdrawn one by one and introduced into the machine, drive means disposed on a drive shaft so as to displace the top flat material from the stack to feed it into the machine, the device comprising moreover at least one retaining member adapted to retain the flat material disposed in the stack below the top material; the improvement wherein the retaining member is constituted by a material with fibers arranged on the front wall of the supply chamber, the fibers having a resistance to displacement adapted to retain the flat material by its forward edge and permitting the top flat material in the stack to be driven by said drive means, the front wall of the supply chamber comprising an inclined plane relative to a normal to the bottom, the material with fibers being constituted by strips of cut pile fabric secured in recesses in the inclined plane, and arranged thereon to face the drive means, said strips having a fiber density comprised between 5.000 and 30.000 fibers/cm$^2$, the length of the fibers being comprised between 0.7 and 3 mm, the fibers extending from 0.2 to 1.5 mm beyond the upper surface of the inclined plane.

* * * * *